US006098384A

United States Patent [19]

Porrello

[11] Patent Number: 6,098,384

[45] Date of Patent: Aug. 8, 2000

[54] BREAKAWAY HORSE REIN

[76] Inventor: Joanne B. Porrello, P.O. Box 16, Aidie, Va. 20105-0016

[21] Appl. No.: 09/249,553

[22] Filed: Feb. 12, 1999

[51] Int. Cl.[7] ..... B68B 1/02

[52] U.S. Cl. ..... 54/36

[58] Field of Search ..... 54/36, 52, 34, 54/16, 6.1

[56] References Cited

U.S. PATENT DOCUMENTS

| | | | |
|---|---|---|---|
| 4,094,131 | 6/1978 | McElvey | 54/24 |
| 4,135,348 | 1/1979 | Matthews | 54/24 |
| 4,376,366 | 3/1983 | Miller | 54/24 |
| 4,502,265 | 3/1985 | Horigan | 54/24 |
| 4,850,181 | 7/1989 | Pirotta | 54/22 |
| 5,755,185 | 5/1998 | Gallagher | 119/792 |

*Primary Examiner*—Thomas Price

*Attorney, Agent, or Firm*—Rogers & Killeen

[57] ABSTRACT

A safety insert for a horse rein which separates under a predetermined tension to open the rein and reduce the risk to the rider without damage to the rein.

11 Claims, 1 Drawing Sheet

BREAKAWAY HORSE REIN

BACKGROUND OF THE INVENTION

This invention relates to the safety of riders, and more particularly to the reduction of the risk of injury resulting from entanglement of the rider in the reins when the rider is thrown from a horse.

The risk to animals wearing collars, halters or the like around their neck is well known and various devices have been devised to protect the animal. For example, the Dalton U.S. Pat. No. 3,131,674 dated May 5, 1964 is directed to a safety dog collar which has a latch releasable in response to twisting so that a dog may free himself from the collar in the event it becomes entangled in the underbrush. Further by way of example, U.S. Pat. No. 4,376,366 dated Mar. 15, 1983 is directed to a safety halter or bridle for a horse which includes a spring clip on the headstall or portion encircling the neck of the horse, so that the horse may free himself in the event that the halter becomes caught on a fence post or other structure.

Reins for animals such as horses are generally made of a single piece of leather buckled at both ends to the bridle adjacent the bit. Frequently, reins are made in two independent straps which are knotted or buckled together adjacent the saddle. The attachment of the reins together to form an unbroken loop is necessary to prevent inadvertent loss of one rein by the rider.

However, such reins pose a serious risk for the rider as contrasted with the horse. Riders are occasionally thrown from their mounts, and entanglement with the reins is not uncommon. In most cases, the thrown rider is able to effect disengagement from the reins before serious injury occurs, but the occasion of the thrown rider often results from circumstances which the mount has been startled, causing it to bolt. In the absence of immediate disentanglement from the reins, the rider may be dragged by the mount and serious injury, even death, is likely to result.

Reins are often expensive. They are generally made of good quality leather and may be decorated with silver ornaments. Damage to the rein is also to be avoided.

Accordingly, it is an object of the present invention to provide a novel safety insert for reins which will effect the separation of the rein in the event of sufficient tension and thus protect both the rider and the rein.

In one embodiment, the safety insert of the present invention comprises a short strap insertable into the rein. It is known to construct reins for horses or like animals which are made in sections so that a portion of the rein may be manually disconnected and used, e.g., as a hitching strap. U.S. Pat. No. 631,483 dated Aug. 22, 1899 discloses a multiple section rein of this type. However, applicant is unaware of the division of a rein into separable portions for safety purposes.

It is another object of the present invention to provide a novel insert for a rein which is separable under predetermined tension to protect both the rider and the rein.

It is yet another object of the present invention to provide a novel insert for a rein connected thereto by a frangible buckle.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
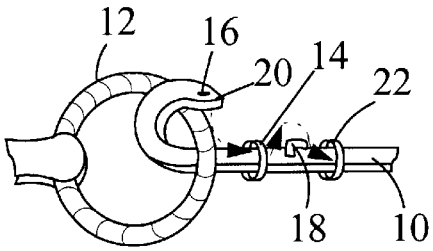
FIGURE 1 PRIOR ART
FIG. 1 is a pictorial representation of a prior art rein as attached to the a bit.

With reference to FIG. 1, the usual prior art reins include a first end selectively attachable to one side of the headstall adjacent the bit. The attachment may be in any suitable conventional way, desirably as shown in FIG. 1 where the rein 10 passes over the ring 12 of the bit, passes through a fixed leather strap or keeper 14, and a hole 16 therein is hooked on a metal prong 18 with the end 20 of the strap passing through another keeper 22.

For English bridles, the reins are the same length and are generally attached to the bridle in the same way on both sides.

Figure 2:
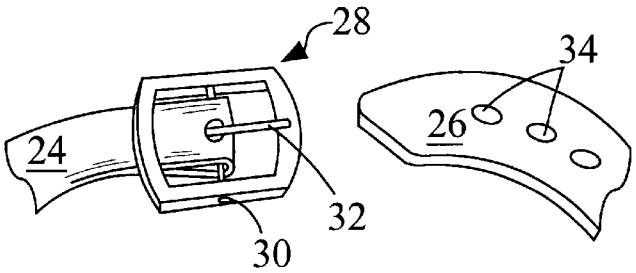
FIGURE 2 PRIOR ART
FIG. 2 is a pictorial representation of a prior art reins as conventionally buckled together in front of the saddle.
Figure 4:
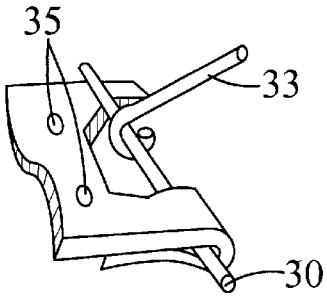
FIG. 4 is a pictorial representation of one embodiment of the frangible buckle of the safety insert of FIG. 3.
Figure 3:
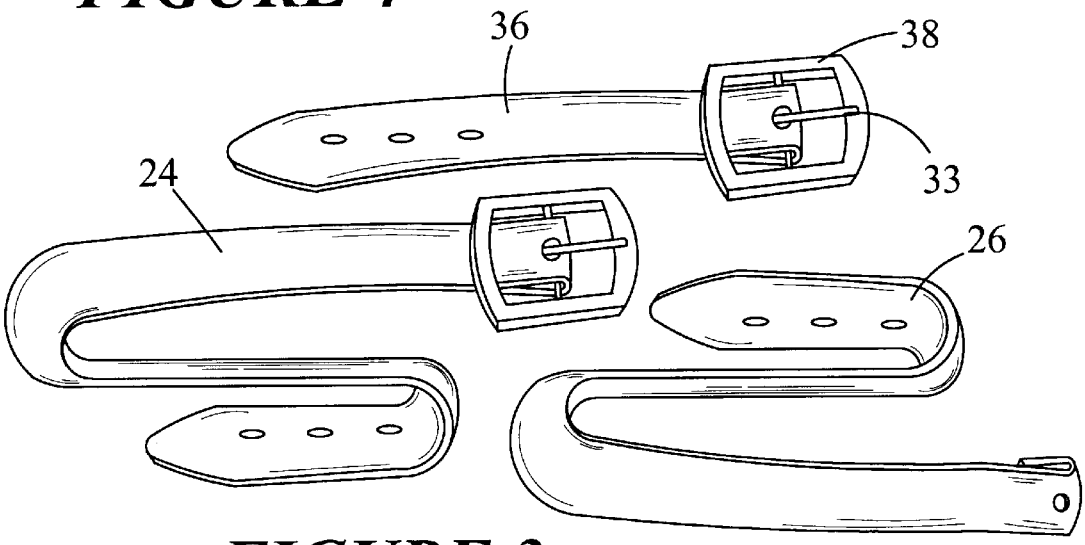
FIG. 3 is a pictorial representation of a one embodiment of the insert of the present invention showing the coupling thereof to the prior art reins.

As shown in FIGS. 2, the two reins 24, 26 from opposite sides of the bridle are usually secured to each other by a non-frangible buckle 28. The rein 24 may be secured to the buckle 28 in any suitable conventional way, such as by a metal pin 30 extending through a loop formed in the rein and maintained by stitching or rivets. As shown in FIG. 3, a tongue 32 may be attached to the pin 30 in a conventional manner, and used to mate with one of the holes 34 provided in the end of the other rein 26.

With reference to FIG. 3, the present invention in its preferred embodiment includes a short leather insert 36 with a frangible buckle 38. The insert 36 may be connectable into a conventional metal buckle 28 of the prior art rein 24 with and connected into the other rein 26 by the frangible buckle of the insert of the present invention. The insert 36 is desirably between about four inches and about six inches in length, and the tongue 33 of the buckle 38 may be constructed of any suitable conventional frangible material such as a thermoplastic, selected to break under a pressure of about eight pounds.

Figure 5:
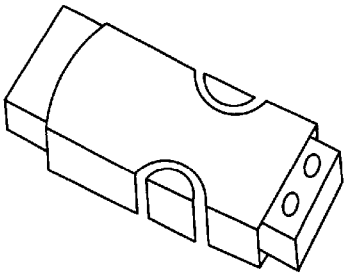
FIG. 5 is a pictorial representation of a second embodiment of the frangible buckle of the present invention.

As an alternative to the specific buckle shown in the Figures, the buckle may be one of the common box style plastic buckles illustrated in FIG. 5 and often found on backpacks and the like with a spring loaded snap of detent to effect release under the desired pressure.

By the use of the insert, frangibility may be inserted into either one or both of the reins at any point rather than just at the ends thereof where the reins are connected to each other. In addition, it is possible to replace the buckle 28 of the prior art rein shown in FIG. 2 with the buckle 38 of the present invention and eliminate the insert.

Note however, that it is desirable to have the frangible buckle at a point further away from the bit than the midpoint of the reins. A location at a point of the reins beyond that where the reins are grasped by the rider will avoid inadvertent breaking from the tension put on the reins by the rider in the handling of the horse. This location will also cause the breaking of the buckle at a point which is more likely to immediately free the rider and thus reduce the risk of injury.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. For use in combination with the leather rein of a horse attached at opposite ends to the headstall of a horse bridle and having a buckle intermediate its length for selectively parting the rein, a safety insert comprising:

a tongue having a length at least an order of magnitude shorter than the length of the rein, one end of said insert tongue being suitable for buckling to the buckle of a horse rein in a conventional manner and the other end of said insert tongue having a buckle suitable for buckling to the free end of a horse rein in a conventional manner, said insert tongue buckle being made of a material frangible under a predetermined tension so that the application of said predetermined tension to a rein into which said insert is buckled will result in the separation of the rein without damage to the rein thereby reducing the risk of injury to the rider.

2. The safety insert of claim 1 wherein said buckle is made of a plastic.

3. The safety insert of claim 1 wherein said buckle is made of a metal.

4. The safety insert of claim 1 wherein said buckle is frangible under a tension of less that ten pounds.

5. The safety insert of claim 1 wherein said buckle is frangible under tension of about six to eight pounds.

6. The safety insert of claim 1 wherein said tongue is leather.

7. A safety rein for a horse comprising:

a first relatively long leather strap adapted at one end to be selectively secured to a headstall bit of a horse bridle adjacent one end of the bit and having a buckle at the other end;

a second relatively long leather strap adapted at one end to be selectively secured to the headstall bit of the horse bridle adjacent the other end of the bit and being configured at the other end for insertion into a buckle, a third strap insert having a length at least an order of magnitude shorter than the length of said first and second strap, one end of said insert strap being suitable for buckling to the buckle of said first strap and the other end of said insert strap having a frangible buckle suitable for buckling to the other end of said second strap, the buckling of said first, second and third straps forming an integral rein for the horse connected at opposite ends to the opposite ends of the bridle bit, said insert buckle being made of a material frangible in response to the application of a predetermined tension to the integral rein so that said second strap separates from said strap insert upon the application of said predetermined tension to said integral rein without damage to said first or second reins thereby reducing the risk of injury to the rider.

8. The safety rein of claim 7 wherein the frangible buckle includes a metal buckle secured to the strap by a metal pin and a frangible tongue carried by said metal pin for selective insertion into a hole in said second strap.

9. The safety insert of claim 8 wherein said buckle is frangible under tension of about six to eight pounds.

10. The method of reducing the risk of injury to a rider from entanglement with the reins of a mount in the event that the rider is thrown from the mount, the method comprising the steps of:

(a) providing a relatively long leather rein for a mount which will not separate under a predetermined tension;

(b) providing a relatively short leather insert with a buckle frangible under the predetermined tension;

(c) buckling the relatively short insert into the relatively long rein to thereby create a composite rein which will separate upon the application of the predetermined tension thereto.

11. The method of claim 10 wherein the insert is between about four and about six inches in length.

* * * * *